US008302232B2

(12) United States Patent
Bae et al.

(10) Patent No.: US 8,302,232 B2
(45) Date of Patent: Nov. 6, 2012

(54) WASHING MACHINE AND METHOD OF CONTROLLING A WASHING MACHINE

(75) Inventors: Sun Cheol Bae, Changwon-si (KR); Kyung Hoon Kim, Changwon-si (KR); Han Su Jung, Changwon-si (KR); Jae Hyeok Choi, Changwon-si (KR); Ja In Koo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 418 days.

(21) Appl. No.: 12/470,815

(22) Filed: May 22, 2009

(65) Prior Publication Data

US 2009/0300853 A1 Dec. 10, 2009

(30) Foreign Application Priority Data

May 23, 2008 (KR) ..... 10-2008-0048277

(51) Int. Cl.
*D06F 33/00* (2006.01)

(52) U.S. Cl. ..... 8/159; 68/24; 68/140

(58) Field of Classification Search ..... 8/158, 159; 68/12.06

See application file for complete search history.

(56) References Cited

U.S. PATENT DOCUMENTS 3,301,024 A * 1/1967 Smith ..... 68/12.15
4,782,544 A 11/1988 Nystuen et al. ..... 8/159
5,207,764 A * 5/1993 Akabane et al. ..... 68/20
5,671,494 A 9/1997 Civanelli et al.
5,692,313 A * 12/1997 Ikeda et al. ..... 34/58
5,768,730 A 6/1998 Matsumoto et al. ..... 8/159
5,887,456 A 3/1999 Tanigawa et al. ..... 68/20
6,029,299 A 2/2000 Baek et al. ..... 8/159
6,240,586 B1 6/2001 Joo ..... 8/159
6,381,791 B1 5/2002 French et al. ..... 8/159
6,578,225 B2 * 6/2003 Jonsson ..... 8/159

(Continued)

FOREIGN PATENT DOCUMENTS

CA 2 360 476 C 5/2002

(Continued)

OTHER PUBLICATIONS

Korean Office Action dated Mar. 29, 2010 issued in Application No. 10-2008-0048182.

(Continued)

*Primary Examiner* — Frankie L Stinson
(74) *Attorney, Agent, or Firm* — KED & Associates LLP

(57) ABSTRACT

The present invention relates to a washing machine and a method of controlling the washing machine. According to a washing machine and a method of controlling the washing machine in accordance with the present invention, a drum operates at a first speed so that part of the laundry tumbles within the drum and another part of the laundry adheres within the drum. The drum operates at a second speed lower than the first speed so that an amount of the tumbling laundry is more increased than at the first speed. Accordingly, at the time of a dehydration cycle, stability of the washing machine and laundry balancing can be ensured.

18 Claims, 10 Drawing Sheets

U.S. PATENT DOCUMENTS

| | | | | |
|---|---|---|---|---|
| 7,412,740 | B2 | 8/2008 | Park et al. | 8/159 |
| 7,478,547 | B2 * | 1/2009 | Okazaki et al. | 68/12.04 |
| 7,490,490 | B2 * | 2/2009 | Hirasawa et al. | 68/12.04 |
| 7,530,133 | B2 * | 5/2009 | Mitts | 8/159 |
| 7,627,920 | B2 | 12/2009 | Wong et al. | 8/159 |
| 2002/0020196 | A1 | 2/2002 | Kakuda et al. | |
| 2003/0140427 | A1 | 7/2003 | Yamamoto et al. | 8/159 |
| 2005/0102766 | A1 * | 5/2005 | Vande Haar et al. | 8/159 |
| 2005/0251926 | A1 | 11/2005 | Lee et al. | |
| 2005/0268670 | A1 | 12/2005 | Hirasawa et al. | 68/12.06 |
| 2006/0005319 | A1 | 1/2006 | Park | 8/158 |
| 2006/0107299 | A1 | 5/2006 | Bartfeld et al. | 75/110 |
| 2006/0185095 | A1 | 8/2006 | Mitts | 8/158 |
| 2006/0207299 | A1 | 9/2006 | Okazaki et al. | 68/12.02 |
| 2008/0289118 | A1 | 11/2008 | Park et al. | 8/159 |
| 2009/0307851 | A1 | 12/2009 | Bae et al. | 8/159 |

FOREIGN PATENT DOCUMENTS

| | | | | |
|---|---|---|---|---|
| CN | 1966812 | A | | 5/2007 |
| DE | 36 06 819 | A1 | | 9/1987 |
| DE | 38 40 265 | | * | 5/1990 |
| DE | 41 22 307 | A1 | | 1/1993 |
| DE | 42 29 646 | A1 | | 3/1994 |
| DE | 44 38 760 | A1 | | 5/1996 |
| DE | 102 34 373 | A1 | | 2/2004 |
| DE | 10 2006 017 530 | A1 | | 10/2007 |
| EP | 0 807 706 | | | 11/1997 |
| EP | 1 516 952 | A2 | | 3/2005 |
| EP | 1 538 251 | A2 | | 6/2005 |
| EP | 1 760 181 | A1 | | 3/2007 |
| GB | 2 073 257 | | | 10/1981 |
| GB | 2 327 502 | | * | 1/1999 |
| JP | 64-040093 | | | 2/1989 |
| JP | 01-268597 | A | | 10/1989 |
| JP | 02-109953 | | | 4/1990 |
| JP | 02-136173 | A | | 5/1990 |
| JP | 04-176494 | | * | 6/1992 |
| JP | 06-218181 | | * | 8/1994 |
| JP | 08-299660 | | * | 11/1996 |
| JP | 10-005485 | A | | 1/1998 |
| JP | 10-127978 | A | | 5/1998 |
| JP | 10-216391 | A | | 8/1998 |
| JP | 11-216296 | A | | 8/1999 |
| JP | 2000-157788 | A | | 6/2000 |
| JP | 2001-224889 | A | | 8/2001 |
| JP | 2005-199090 | | * | 7/2005 |
| JP | 2008-054960 | A | | 3/2008 |
| KR | 10-1994-0015033 | A | | 7/1994 |
| KR | 10-2000-0033342 | A | | 6/2000 |
| KR | 10-2001-0004704 | A | | 1/2001 |
| KR | 2004046049 | | * | 6/2004 |
| KR | 10-2005-0012524 | A | | 2/2005 |
| KR | 10-2005-0042945 | A | | 5/2005 |
| KR | 10-2006-0049526 | A | | 5/2006 |
| WO | WO 00/28128 | A1 | | 5/2000 |
| WO | WO 2004/009899 | A1 | | 1/2004 |
| WO | WO 2005/106096 | A1 | | 11/2005 |

OTHER PUBLICATIONS

Korean Office Action dated Mar. 16, 2010 issued in Application No. 10-2008-0048186.
European Search Report dated Sep. 11, 2009 issued in Application No. 09 16 0861.
European Search Report dated Aug. 6, 2009 issued in Application No. 09 16 0863.
Canadian Office Action dated May 30, 2011 issued in Application No. 2,666,777.
Canadian Office Action dated May 30, 2011 issued in Application No. 2,666,779.
U.S. Office Action dated Jul. 19, 2011 issued in U.S. Appl. No. 12/466,495.
Chinese Office Action dated Aug. 19, 2010 issued in Application No. 200910141732.1.
Korean Office Action dated Mar. 29, 2010 for Application No. 10-2008-0048184.
Korean Office Action dated Mar. 30, 2010 for Application No. 10-2008-0048183.
Korean Office Action dated Mar. 16, 2010 for Application No. 10-2008-0048185.
Korean Office Action dated Mar. 16, 2010 for Application No. 10-2008-0048277.
Chinese Office Action dated Oct. 20, 2010 issued in Application No. 200910141728.6.
German Office Action dated Jul. 5, 2011 issued in Application No. 10 2009 021 942.0.
German Office Action dated Jul. 5, 2011 issued in Application No. 10 2009 021 947.1.
German Office Action dated Jul. 8, 2011 issued in Application No. 10 2009 021 941.2.
German Office Action dated Jul. 8, 2011 issued in Application No. 10 2009 021 949.8.
United States Office Action dated Aug. 23, 2011 issued in U.S. Appl. No. 12/470,804.
United States Office Action dated Aug. 23, 2011 issued in U.S. Appl. No. 12/470,818.
United States Office Action dated Aug. 24, 2011 issued in U.S. Appl. No. 12/470,800.
U.S. Office Action dated Oct. 31, 2011 issued in U.S. Appl. No. 12/466,513.
U.S. Office Action dated Jan. 10, 2012 in U.S. Appl. No. 12/466,495.
U.S. Office Action dated Mar. 6, 2012 in U.S. Appl. No. 12/470,800.
Notice of Allowance dated Mar. 16, 2012 in U.S. Appl. No. 12/470,818.
U.S. Office Action dated Apr. 5, 2012 in U.S. Appl. No. 12/466,513.
U.S. Office Action dated Jun. 27, 2012 issued in U.S. Appl. No. 12/470,800.
U.S. Office Action dated Jul. 25, 2012 issued in U.S. Appl. No. 12/466,495.

* cited by examiner

WASHING MACHINE AND METHOD OF CONTROLLING A WASHING MACHINE

This application claims priority from Korean Patent Application No. 10-2008-0048277, filed May 23, 2008, the subject of which is incorporated herein by reference.

BACKGROUND

1. Field

Embodiments of the present invention may relate to a washing machine and a method of controlling a washing machine and, more particularly, to a washing machine with improved stability and improved laundry balancing at the time of a dehydration cycle, and a method of controlling a washing machine.

2. Background

A drum-type washing machine of washing machines is configured to perform washing by employing a drum that rotates by driving force of a motor and frictional force of the laundry in the state in which a detergent, wash water, and the laundry are input to the drum. Thus, the drum-type washing machine does rarely damage the laundry, has the laundry rarely get entangled, and has knocking and rubbing washing effects.

After wash and rinse cycles are finished, a dehydration cycle is performed. In order to perform the dehydration cycle, laundry must be distributed effectively. To this end, a variety of methods have been used. For example, a method of determining an unbalance amount in the state in which laundry is adhered to the drum was used. However, this method is disadvantageous in that it has a long balancing time of laundry and the state of laundry is decided by sensing an unbalance amount of the laundry in the state in which the laundry is adhered to the drum. Further, in the case in which laundry is unbalanced with the laundry being adhered to the drum, it becomes problematic in the stability of a washing machine.

BRIEF DESCRIPTION OF THE DRAWINGS

Objects and features of arrangements and embodiments of the present invention may become apparent from the following description taken in conjunction with the accompanying drawings, in which like reference numerals refer to like elements and wherein.

DETAILED DESCRIPTION

Arrangements and embodiments of the present invention may be described in detail with reference to the accompanying drawings.

Figure 1:
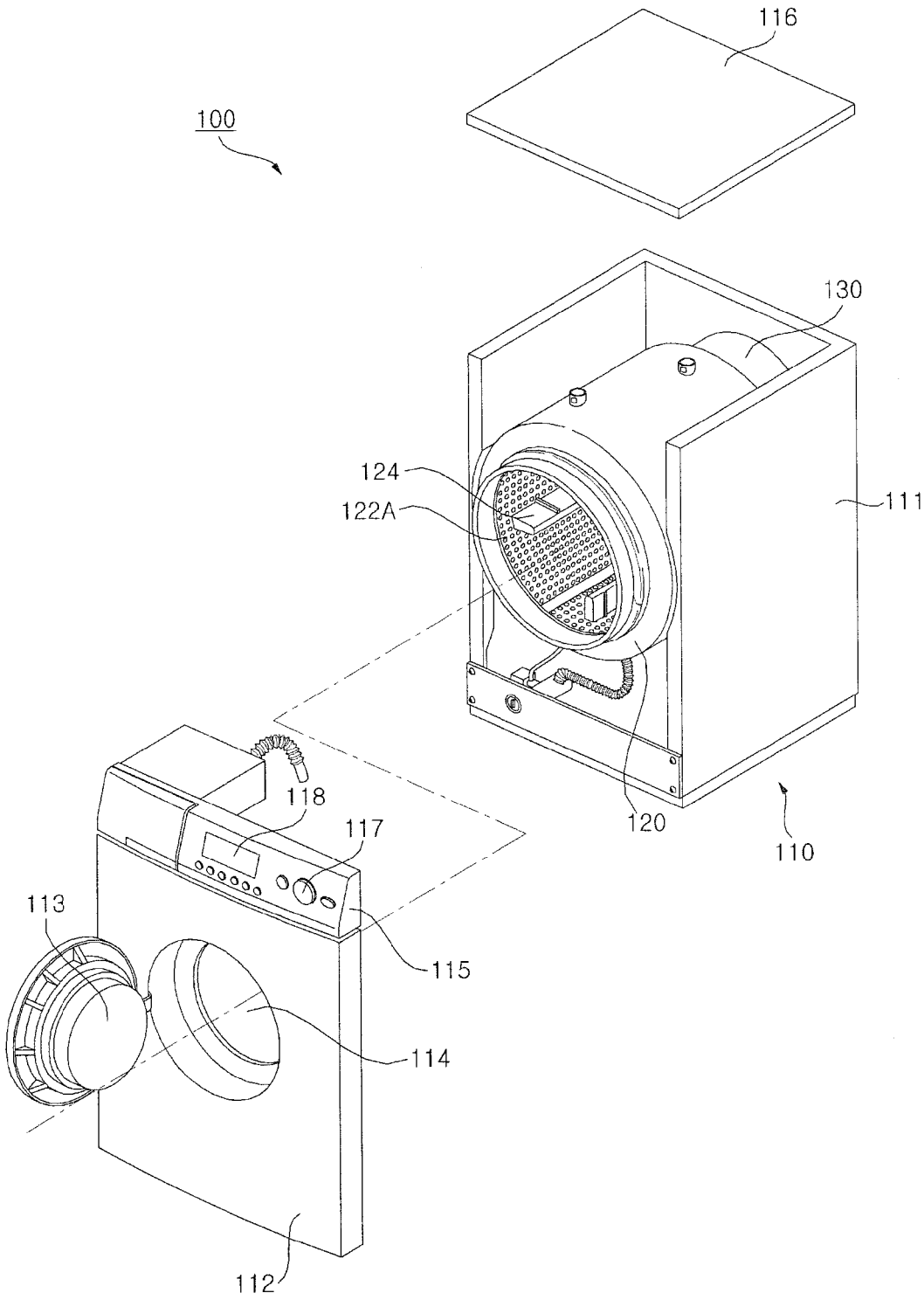
FIG. 1 is a perspective view showing a washing machine in accordance with an embodiment of the present invention.

FIG. 1 is a perspective view showing a washing machine in accordance with an embodiment of the present invention.

Description is given below with reference to the drawing. A washing machine 100 includes a cabinet 110 forming an external shape of the washing machine 100, a tub 120 disposed within the cabinet 110 and supported by the cabinet 110, a drum 122 disposed within the tub 120 in which laundry is washed, a motor 130 for driving the drum 122, a wash water supply apparatus (not shown) disposed outside a cabinet main body 111 and configured to supply wash water to the cabinet 110, and a drain apparatus (not shown) formed under the tub 120 and configured to drain wash water to the outside.

A plurality of through-holes 122A for having wash water pass therethrough is formed in the drum 122. Lifters 124 can be disposed within the drum 112 so that the laundry is raised up to a specific height when the drum 122 is rotated and then dropped because of gravity.

The cabinet 110 includes the cabinet main body 111, a cabinet cover 112 disposed on the front side of the cabinet main body 111 and coupled thereto, a control panel 115 disposed on an upper side of the cabinet cover 112 and coupled to the cabinet main body 111, and a top plate 116 disposed at the top of the control panel 115 and coupled to the cabinet main body 111.

The cabinet cover 112 includes a laundry inlet/outlet hole 114 formed to have laundry pass therethrough, and a door 113 disposed rotatably left and right so that the laundry inlet/outlet hole 114 is opened and closed.

The control panel 115 includes a control button 117 for manipulating operating states of the washing machine 100, and a display device 118 disposed on one side of the control button 117 and configured to display operating states of the washing machine 100.

The control button 117 and the display device 118 within the control panel 115 are electrically connected to a controller (not shown). The controller (not shown) electrically controls respective constituent elements, etc. of the washing machine 100. An operation of the controller (not shown) is described later on.

Figure 2:
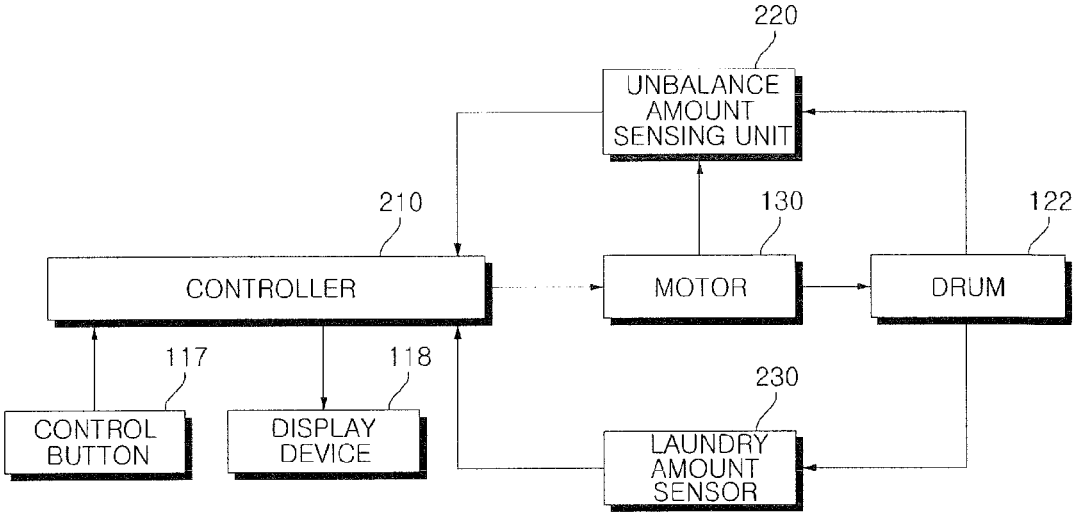
FIG. 2 is an internal block diagram of the washing machine shown in FIG. 1.

FIG. 2 is an internal block diagram of the washing machine shown in FIG. 1.

Description is given below with reference to the drawing. First, a controller 210 operates in response to an operation signal received from the control button 117. Thus, actual washing, rinse, and dehydration cycles can be performed. For the actual washing, rinse, and dehydration cycles, the controller 210 controls the motor 130. Although not shown in the drawings, an inverter (not shown) can be used to control the motor. For example, when the controller 210 outputs a PWM switching control signal to the inverter (not shown), the inverter (not shown) can perform a high-speed switching operation in order to supply an AC power of a specific frequency to the motor 130.

Meanwhile, the controller 210 can display operating states of the washing machine 100 through the display device 118. For example, the controller 210 can display operating states, such as actual washing, rinse, and dehydration cycles, through the display device 118.

The motor 130 drives the drum 122. The drum 122 is disposed within the tub 120, as shown in FIG. 1, and has laundry for washing input therein. The drum 122 is driven by the rotation of the motor 130.

An unbalance amount sensing unit 220 senses an unbalance amount of the drum 122, that is, unbalance (UB) of the drum 122. The unbalance amount can be sensed based on a rotational speed variation of the drum 122, that is, a rotational speed variation of the motor 130. To this end, a speed sensor (not shown) for sensing a rotational speed of the motor 130 can be further included. Meanwhile, a rotational speed of the motor 130 can be calculated based on an output current value flowing through the motor 130, and an unbalance amount can be sensed based on the rotational speed. To this end, the motor 130 can include a current sensor (not shown), for example, an encoder.

Meanwhile, although it is shown that the unbalance amount sensing unit 220 is provided separately from the controller 210, the present invention is not limited to the above example. Alternatively, the unbalance amount sensing unit 220 may be included within the controller 210. In this case, a rotational speed and an output current value of the motor 130, which are respectively sensed by the speed sensor (not shown) and the current sensor (not shown), can be input to the controller 210.

Meanwhile, the washing machine can further include a laundry amount sensor 230. The laundry amount sensor 230 senses the laundry amount within the drum and inputs a sensed laundry amount to the controller 210. Such sensing of the laundry amount can be performed by sensing the weight of laundry within the drum 122, a rotational speed of the drum 122, and the like anytime when the drum is stopped or operated. The laundry amount sensor 230 is illustrated in FIG. 2 as being separate from the controller 210. However, the laundry amount sensor 230 may be included in the controller 210.

Figure 3:
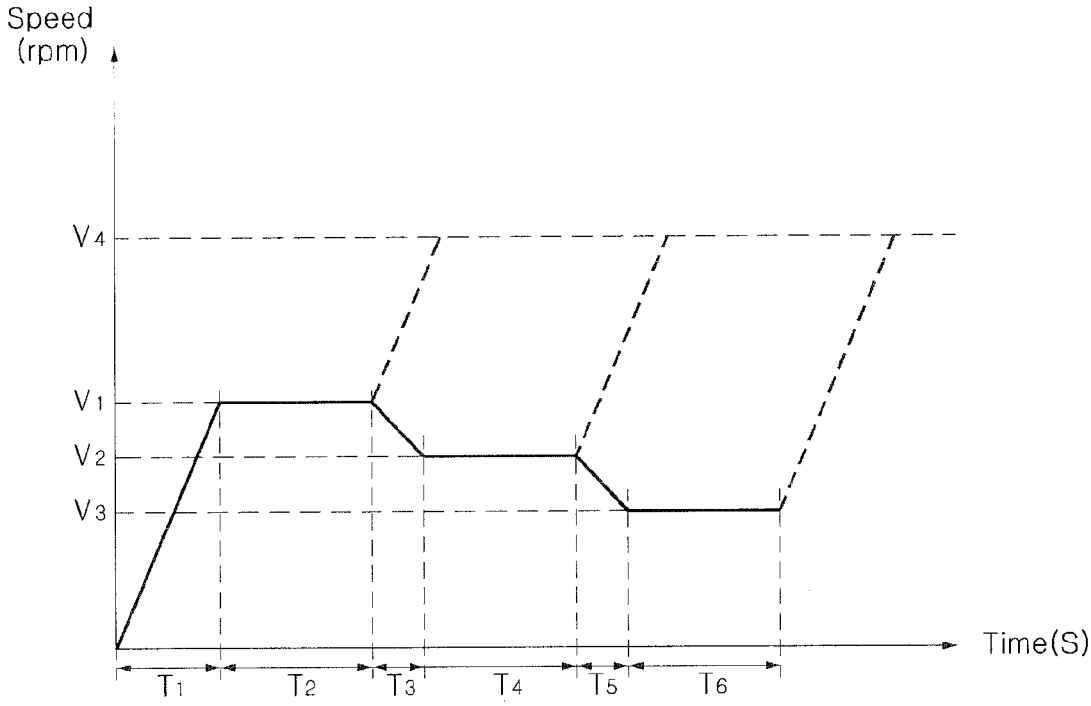
FIG. 3 is a graph showing an example of the relationship between a rotational speed of a drum within the washing machine shown in FIG. 1 and time.
Figure 4:
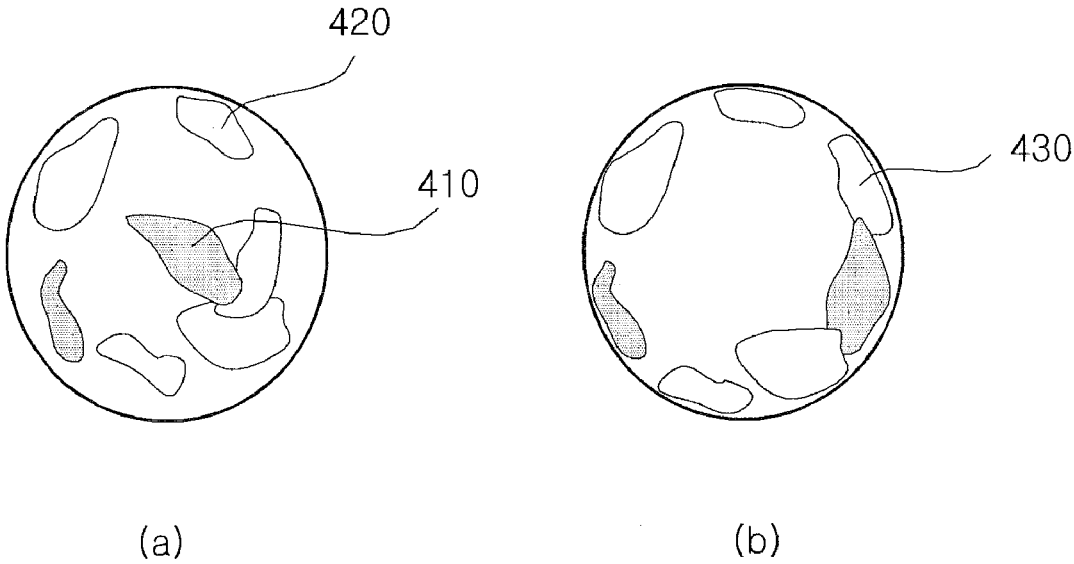
FIG. 4 is a diagram showing the states of laundry within the drum according to a first speed and a fourth speed of FIG. 3.

FIG. 3 is a graph showing an example of the relationship between a rotational speed and time of the drum within the washing machine of FIG. 1. FIG. 4 is a diagram showing the states of laundry within the drum according to a first speed and a fourth speed of FIG. 3.

Description is given below with reference to the accompanying drawings. In relation to the dehydration cycle of the washing machine in accordance with an embodiment of the present invention, first, a rotational speed of the drum 122 is raised to a first speed V1 during a first period T1. Here, the first speed V1 is, as shown in FIG. 4(*a*), a speed at which a part 410 of laundry is tumbled within the drum and the other part 420 of the laundry is adhered within the drum. For example, the first speed V1 may be a speed at which 20 to 30% of a total of laundry is tumbled within the drum and 70 to 80% of the total of laundry is adhered within the drum.

During a second period T2, the drum 122 is operated at the first speed V1.

Next, in order to more increase the amount of the tumbling laundry than at the first speed V1, the rotational speed of the drum 122 drops to a second speed V2 during a third period T3. The second speed V2 is lower than the first speed V1, and is a speed at which a greater amount of the laundry 420 adhered within the drum of FIG. 4(*a*) is tumbled.

During a fourth period T4, the drum 122 is operated at the second speed V2.

Meanwhile, in order to more increase the amount of the tumbling laundry than at the second speed V2, the rotational speed of the drum 122 drops to a third speed V3 during a fifth period T5. The third speed V3 is lower than the second speed V2, and is a speed at which a greater amount of the laundry 420 adhered within the drum of FIG. 4(*a*) is tumbled.

During a sixth period T6, the drum 122 is operated at the third speed V3.

When an unbalance amount of the drum 122 is a reference value or less while the drum is operated at the first speed to the third speed, the drum is operated at a fourth speed V4 at which the entire laundry 430 are adhered within the drum, as shown in FIG. 4(*b*).

Meanwhile, what the drum 122 is operated by gradually decreasing the speed of the drum to the second speed V2 or the third speed V3 can be decided according to the laundry amount, the type of laundry, and the like within the drum 122. For example, when the laundry amount within the drum 122 is a first specific value or more, the drum may be decided to operate at the second speed V2. When the laundry amount within the drum 122 is a second specific value or more, the drum may be decided to operate at the third speed V3. Alternatively, when the laundry amount within the drum 122 is a first specific value or less, the drum may be decided to operate at the second speed V2. When the laundry amount within the drum 122 is a second specific value or less, the drum may be decided to operate at the third speed V3. Meanwhile, the laundry amount can be sensed either when the drum 122 is operated at a specific speed or when the drum 122 is stopped.

Further, to operate the drum 122 by gradually decreasing the speed of the drum to the second speed V2 or the third speed V3 can be decided according to an unbalance amount during the second speed operation or during the third speed operation. For example, when an unbalance amount of the drum 122 during the first speed (V1) operation is within a first specific range, the drum 122 can be decided to operate at the second speed V2, and, when an unbalance amount of the drum 122 during the second speed (V2) operation is within a second specific range, the drum 122 can be decided to operate at the third speed V3.

Further, what the drum 122 is operated by gradually decreasing the speed of the drum to the second speed V2 or the third speed V3 can be decided according to an operating time during the second speed operation or during the third speed operation. For example, when an operating time of the drum 122 during the first speed (V1) operation is a first specific time or more, the drum 122 can be decided to operate at the second speed V2, and, when an operating time of the drum 122 during the second speed (V2) operation is a second specific time or more, the drum 122 can be decided to operate at the third speed V3.

As described above, the distribution state of laundry can be improved by gradually operating the drum 122 over the first speed V1 to the third speed V3 at which a part of the laundry is tumbled within the drum and the other part of the laundry are adhered within the drum. Accordingly, stability of the washing machine 100 and laundry balancing can be improved.

Further, the drum 122 can be driven over the first speed V1 to the third speed V3 at which a part of laundry is tumbled so as to meet the balancing state of the laundry to some extent, not at a speed at which the entire laundry are tumbled as in the prior art, and the drum can be then operated at a fourth speed V4. Accordingly, laundry can be distributed accurately and rapidly.

Meanwhile, the above first speed V1 can be about 62 rpm, the second speed V2 can be about 60 rpm, the third speed V3 can be about 55 rpm, and the fourth speed V4 can be about 108 rpm.

Figure 5:
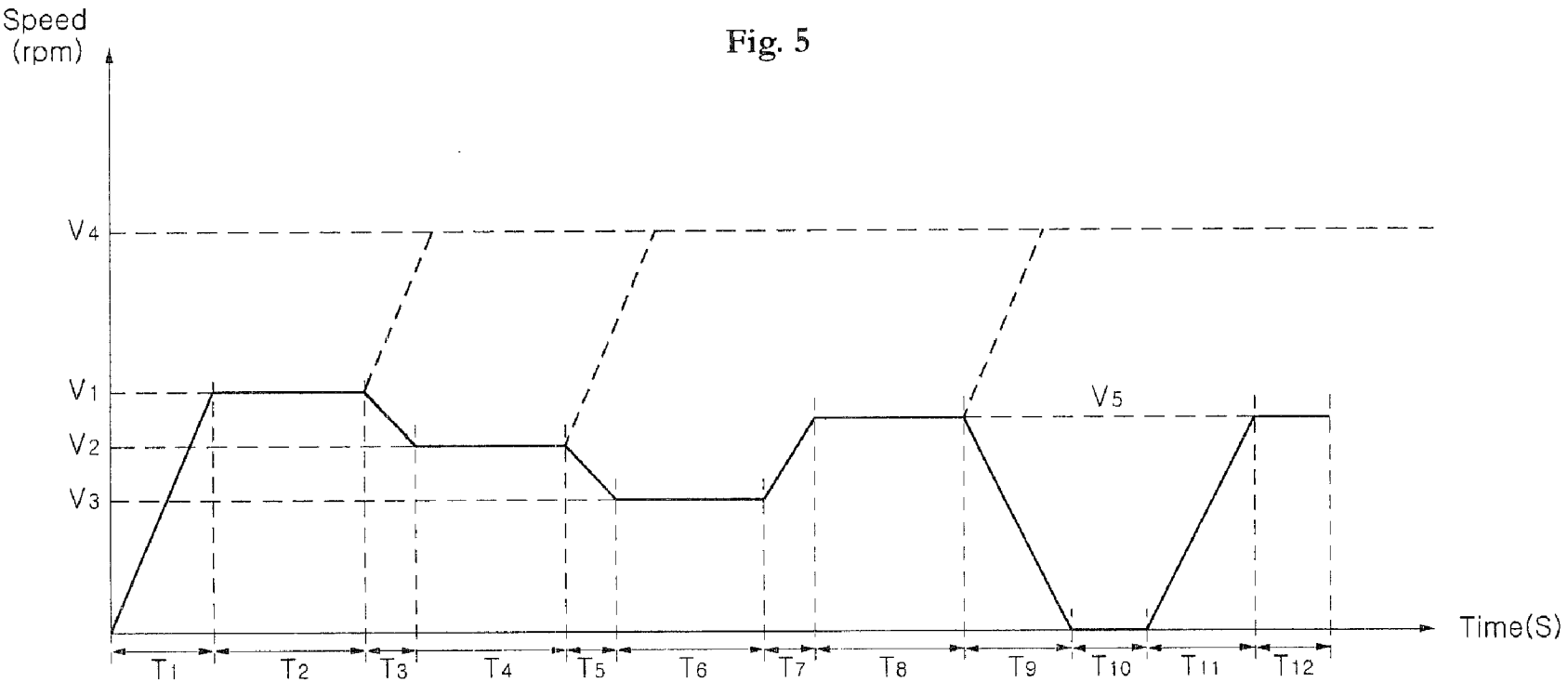
FIG. 5 is a graph showing an example of the relationship between a rotational speed of the drum within the washing machine shown in FIG. 1 and time.

FIG. 5 is a graph showing an example of the relationship between a rotational speed of the drum within the washing machine shown in FIG. 1 and time.

Description is given below with reference to the drawings. FIG. 5 is almost similar to that of FIG. 3. In other words, FIG. 5 is identical to FIG. 3 in that the drum is operated step by step at the first speed V1 to the third speed V3 during the first to sixth periods T1 to T6.

However, after the sixth period T6, the rotational speed of the drum 122 is raised up to a fifth speed V5 during a seventh period T7 such that the drum is operated at the fifth speed V5 calculated based on the first to third speeds V1 to V3.

During an eighth period T8, the drum is operated at the fifth speed V5. Here, the fifth speed V5 may be an average of the first to third speeds V1 to V3. The fifth speed V5 may be a speed, which is calculated by comprehensively considering an unbalance amount, the laundry amount, a speed, etc. when the drum is operated at the first to third speeds V1 to V3. Preferably, the fifth speed V5 may be a speed at which the distribution state of laundry is optimal.

On the other hand, when the drum is operated again, the drum can be immediately driven at the first speed V1, but may be driven at the fifth speed V5 as shown in FIG. 5.

It is shown in FIG. 5 that the rotational speed of the drum drops to a stop speed during a ninth period T9, is stopped during a tenth period T10, rises to the fifth speed V5 during an eleventh period T11, and is then operated at the fifth speed V5 during a twelfth period T12. However, the present invention is not limited to the above example. In other words, not in the case in which the drum is stopped when abnormality occurs during the fifth speed (V5) operation, but in the case in which the drum is stopped when abnormality occurs during an operation at any speed and is then operated again, the drum may be operated at the fifth speed V5.

Meanwhile, in the case in which an unbalance amount of the drum during the fifth speed (V5) operation is a third specific value or less, the drum may be driven at the fourth speed V4 at which the entire laundry are adhered within the drum.

The drum is operated at the fifth speed V5 so as to meet a laundry balancing state to some extent and then enters the fourth speed V4. Accordingly, laundry can be distributed accurately and rapidly.

Meanwhile, although not shown in the drawings, after the fourth speed (V4) operation at which the entire laundry are adhered within the drum 122, at least once water drain process that is operated at a resonant speed or less may be performed so as to remove moisture contained within laundry. After the water drain process is completed, an actual dehydration process that is operated at a maximum speed of the drum may be performed.

Meanwhile, the relationships between the rotational speed of the drum within the washing machine and the time, as shown in FIGS. 3 and 5, were established based on the operating states of the controller 210. In other words, the controller 210 can control an operation speed, an operating time and the like of the drum 122 by considering an unbalance amount of the drum 122, operation commands, the laundry amount, the type of laundry and the like.

Figure 6:
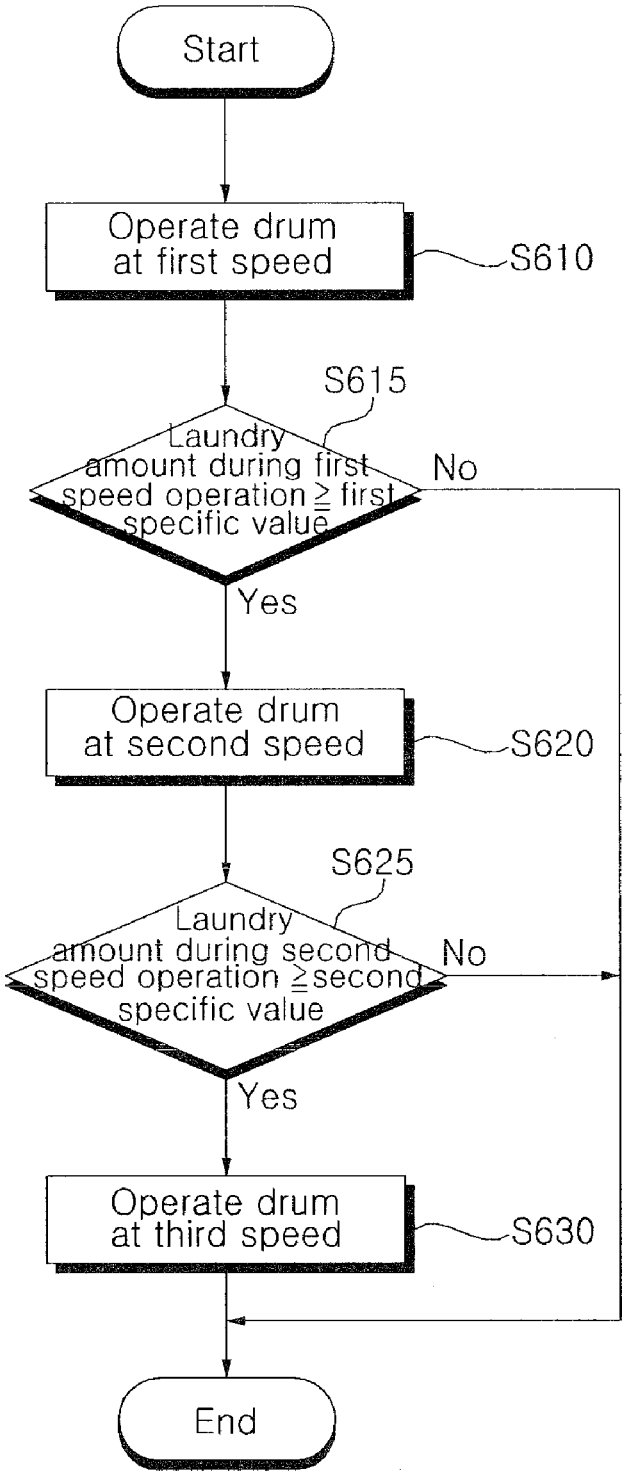
FIG. 6 is a flowchart illustrating a method of controlling the washing machine in accordance with an embodiment of the present invention.

FIG. 6 is a flowchart illustrating a method of controlling the washing machine in accordance with an embodiment of the present invention.

Description is given below with reference to the drawings. The controller 210 controls the drum 122 to operate at the first speed V1 in step S610. The first speed V1 is a speed at which a part of laundry is tumbled within the drum 122 and the other part of the laundry is adhered within the drum.

The controller 210 then determines whether a laundry amount during the first speed operation is a first specific value or more in step S615. In other words, the controller 210 compares a laundry amount sensed by the laundry amount sensor 230 with a first specific value (that is, a preset reference value).

If, as a result of the determination, the laundry amount is the first specific value or more, the controller 210 controls the drum to operate at the second speed V2 in step S620. The second speed V2 is lower than the first speed V1, and is a speed at which the amount of the tumbling laundry within the drum 122 is more increased than at the first speed V1.

Next, the controller 210 determines whether a laundry amount during the first speed operation is a second specific value or more in step S625.

If, as a result of the determination, the laundry amount during the first speed operation is the second specific value or more, the controller 210 controls the drum to operate at the third speed V3 in step S630. The third speed V3 is lower than the second speed V2, and is a speed at which the amount of the tumbling laundry within the drum 122 is more increased than at the second speed V2.

As described above, as the drum is operated at the first to third speeds V1 to V3 step by step, the distribution state of laundry can be improved. Accordingly, stability of the washing machine 100 and laundry balancing can be improved.

Figure 7:
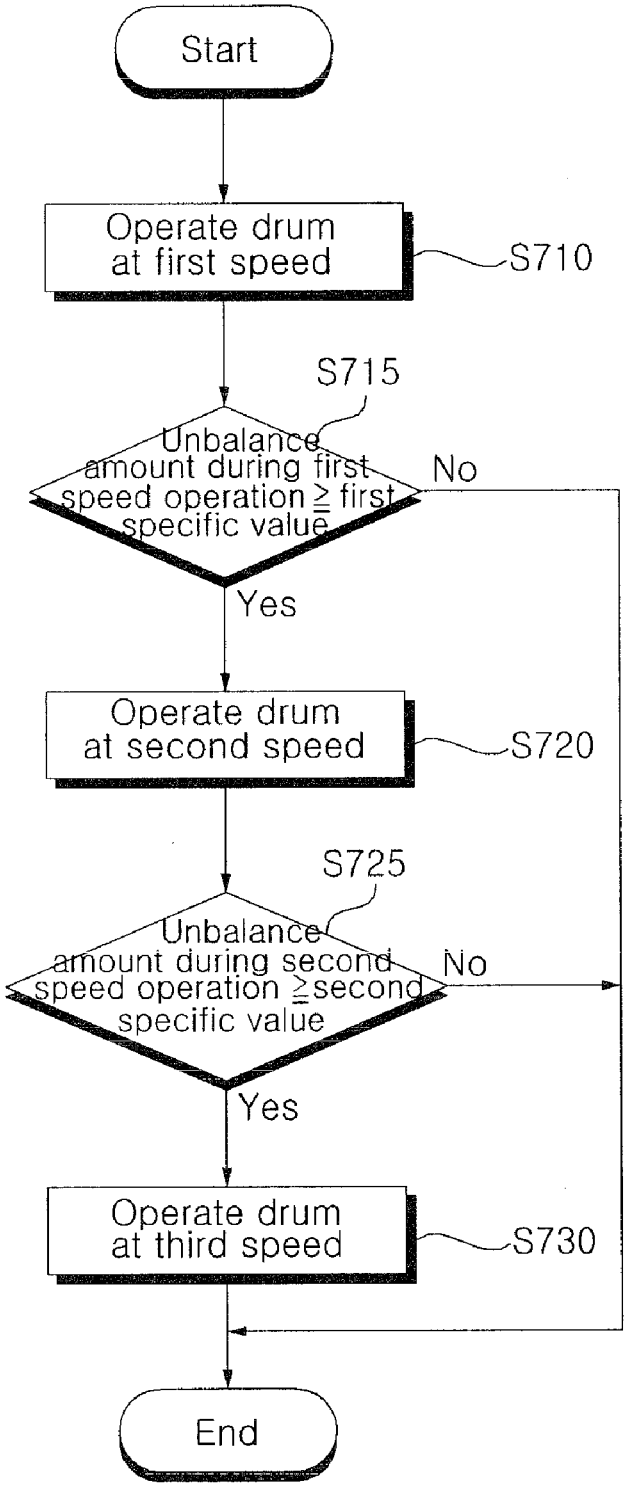
FIG. 7 is a flowchart illustrating a method of controlling the washing machine in accordance with an embodiment of the present invention.

FIG. 7 is a flowchart illustrating a method of controlling the washing machine in accordance with an embodiment of the present invention.

Description is given below with reference to the drawings. The control method of FIG. 7 is identical to that of FIG. 6 except that a criterion to determine an operation per on a step basis is not a laundry amount, but an unbalance amount at the time of an operation per on a step basis. Thus, redundant description will be omitted for simplicity.

That is, the second speed operation (S720) is performed when an unbalance amount during the first speed (V1) operation is within a first specific range, and the third speed operation (S730) is performed when an unbalance amount during the second speed (V2) operation is within a second specific range.

Figure 8:
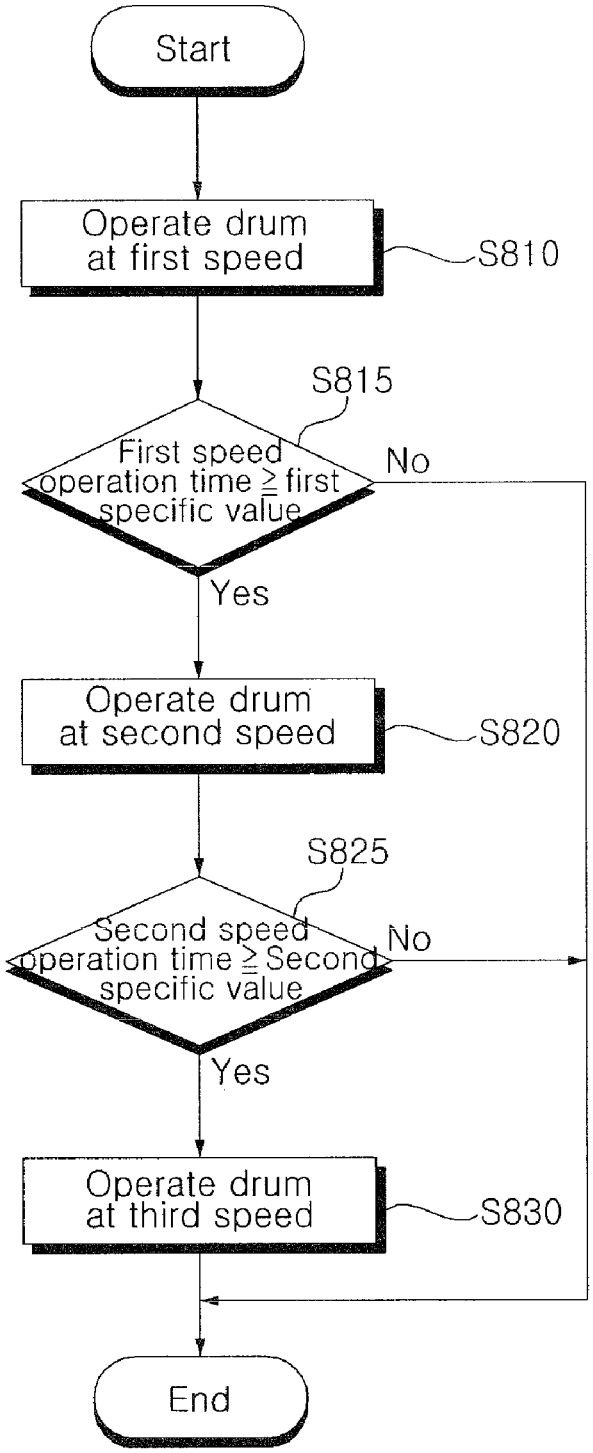
FIG. 8 is a flowchart illustrating a method of controlling the washing machine in accordance with an embodiment of the present invention.

FIG. 8 is a flowchart illustrating a method of controlling the washing machine in accordance with an embodiment of the present invention.

Description is given below with reference to the drawings. The control method of FIG. 8 is identical to that of FIG. 6 except that a criterion to determine an operation per on a step basis is not a laundry amount, but an operating time per on a step basis. Thus, redundant description will be omitted for simplicity.

In other words, the second speed operation (S820) is performed when an operating time during the first speed (V1) operation is within a first specific range, and the third speed operation (S830) is performed when an operating time during the second speed (V2) operation is within a second specific range.

Figure 9:
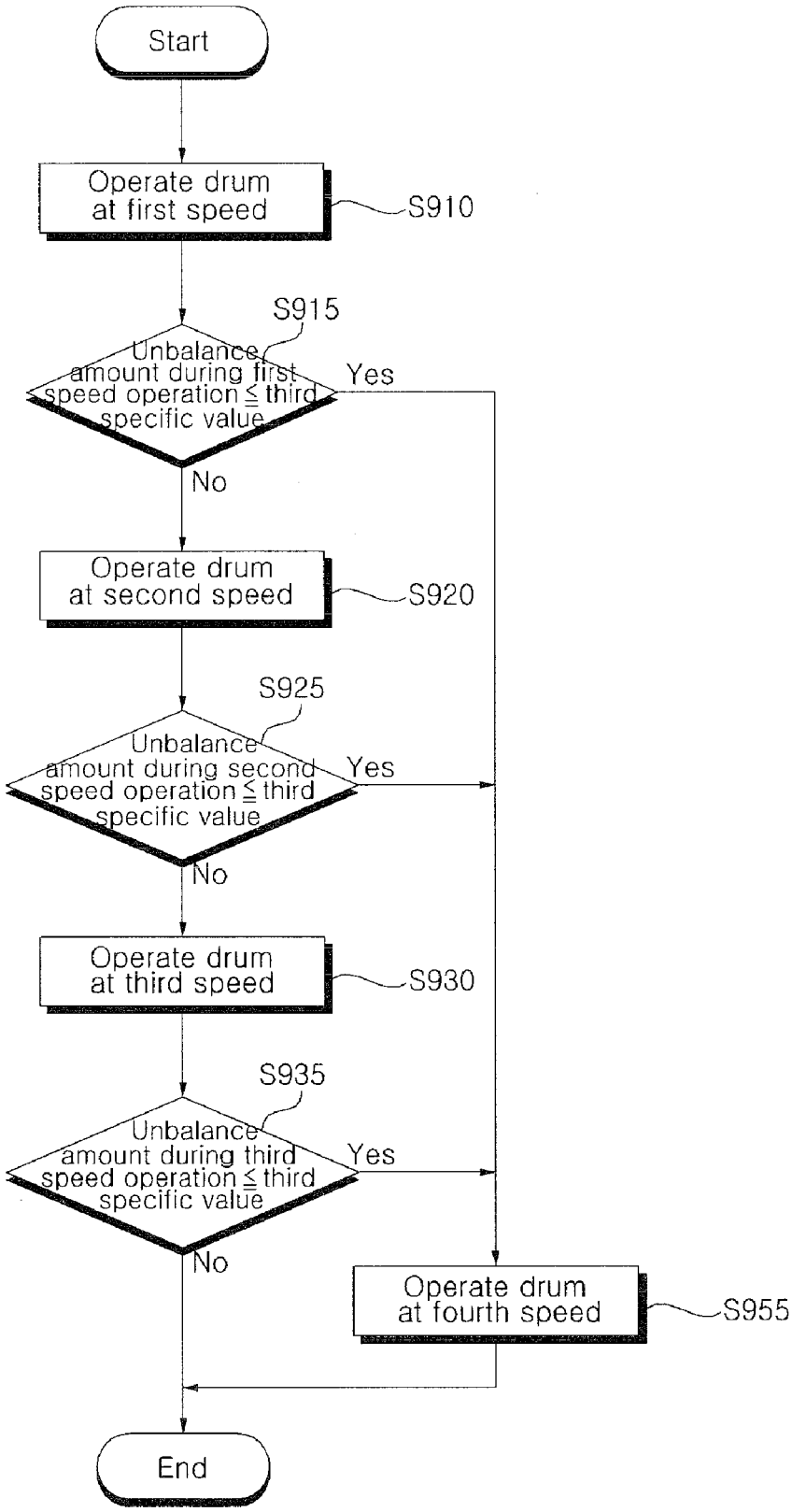
FIG. 9 is a flowchart illustrating a method of controlling the washing machine in accordance with an embodiment of the present invention.

FIG. 9 is a flowchart illustrating a method of controlling the washing machine in accordance with an embodiment of the present invention.

Description is given below with reference to the drawings. The control method of FIG. 9 is almost similar to that of FIG. 7, but differs from that of FIG. 7 in that, when an unbalance amount during the first to third speed (V1 to V3) operations is a third specific value or less, the drum is immediately operated at the fourth speed V4 at which the entire laundry are adhered within the drum 122 (S955).

Figure 10:
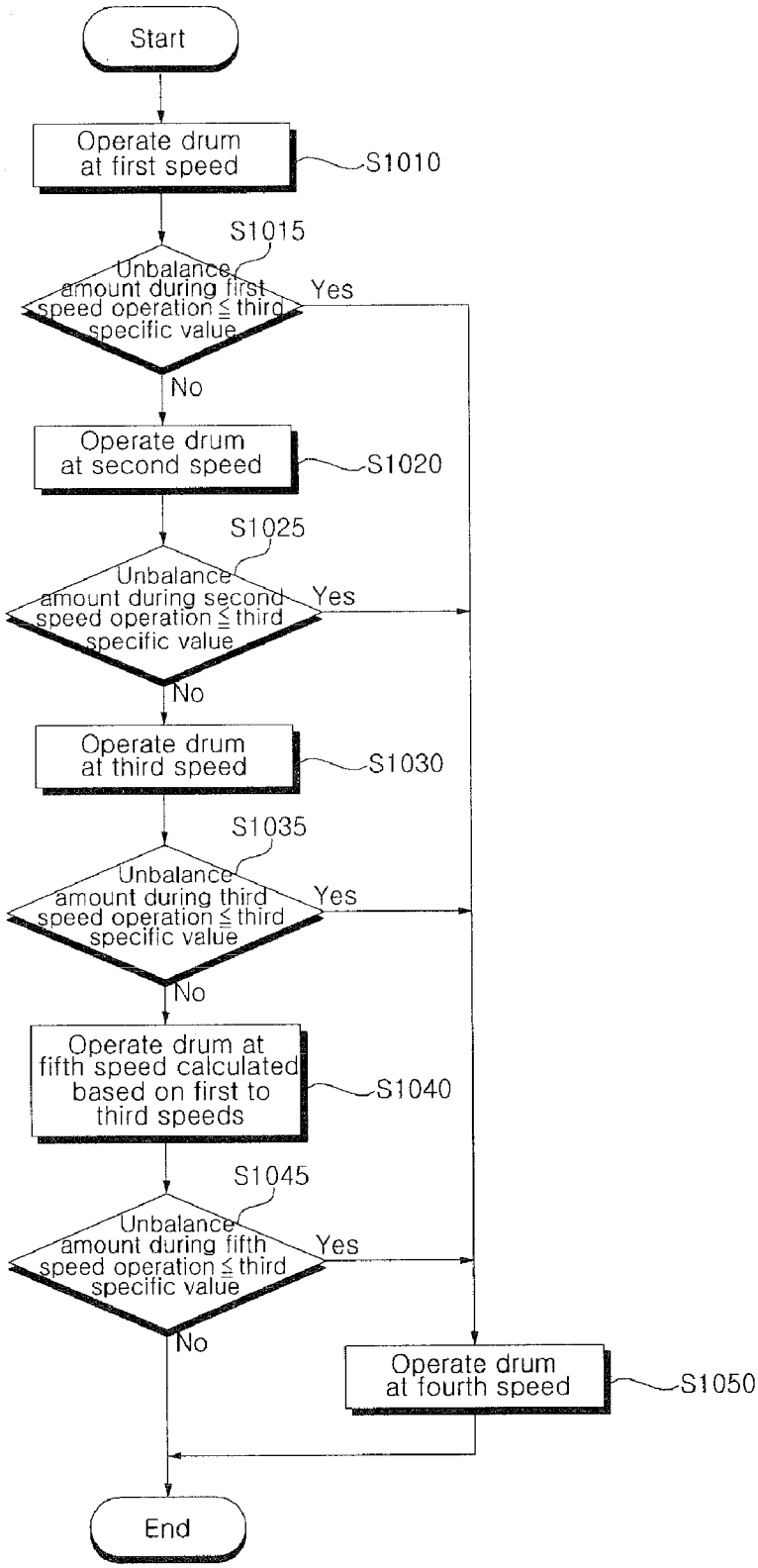
FIG. 10 is a flowchart illustrating a method of controlling the washing machine in accordance with an embodiment of the present invention.

FIG. 10 is a flowchart illustrating a method of controlling the washing machine in accordance with an embodiment of the present invention.

Description is given below with reference to the drawings. The control method of FIG. 10 is almost similar to that of FIG. 9, but differs from that of FIG. 9 in that, after the third speed (V3) operation, the drum is operated at the fifth speed V5 calculated on the basis of the first to third speeds V1 to V3 (S1040). When an unbalance amount is a third specific value or less even when the drum is operated at the fifth speed V5, the drum can be immediately operated at the fourth speed V4 in step S1050.

Here, the fifth speed V5 can be decided by comprehensively considering the speeds V1 to V3 during the first to third speed operations, a laundry amount, an unbalance amount and the like. Preferably, the fifth speed V5 can be a speed at which the distribution state of laundry is optimal. Meanwhile, when the drum 122 is operated again, the drum may be immediately operated at the fifth speed V5.

Meanwhile, the method of controlling the washing machine in accordance with the present invention can be implemented as a processor-readable code in a recording medium, which can be read by a processor equipped in a washing machine. The processor-readable recording medium can include all kinds of recording devices in which data readable by a processor is stored. For example, the processor-readable recording medium can include ROM, RAM, CD-ROM, magnetic tapes, floppy disks, optical data storages, and so on, and can also be implemented in the form of carrier waves, such as transmission over the Internet. Further, the processor-readable recording medium can be distributed into computer systems connected over a network, so codes readable by a processor can be stored and executed in a distributed manner.

In accordance with the embodiments of the present invention, the drum may be operated step by step at a speed at which part of laundry is tumbled within the drum and the other part of the laundry are adhered within the drum. Accordingly, the distribution state of laundry can be improved, and stability of a washing machine and laundry balancing can be improved.

Further, the drum may be driven at a speed at which a part of laundry is tumbled so as to meet the balancing state of the laundry to some extent, not at a speed at which the entire laundry are tumbled as in the prior art, and the drum then enter a speed at which the entire laundry are adhered within the drum. Accordingly, laundry can be distributed accurately and rapidly.

Embodiment of the present invention may provide a washing machine with improved stability and improved laundry balancing at the time of a dehydration cycle, and a method of controlling a washing machine.

An embodiment of the present invention may provide a method of controlling a washing machine including a drum in which laundry are entered and rotated, including the steps of operating the drum at a first speed such that a part of the laundry is tumbled within the drum and the other part of the laundry is adhered within the drum, and operating the drum at a second speed lower than the first speed such that an amount of the tumbling laundry is more increased than at the first speed.

An embodiment of the present invention may provide a washing machine, including a drum in which laundry are entered and rotated, and a controlled for controlling the drum to operate at a first speed such that a part of the laundry is tumbled within the drum and the other part of the laundry is adhered within the drum, and controlling the drum to operate at a second speed lower than the first speed such that an amount of the tumbling laundry is more increased than at the first speed.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a washing machine that includes a drum, the method comprising:

accelerating a rotation speed of the drum to a first speed at which a part of laundry within the drum tumbles and another part of the laundry adheres to the drum;

rotating the drum at the first speed;

decelerating the rotation speed of the drum from the first speed to a second speed at which an amount of the laundry tumbling increases with respect to the first speed, when an unbalance amount of the drum detected during the rotation of the drum at the first speed is a first specific value or more; and rotating the drum at the second speed.

2. The method of claim 1, further comprising decelerating the rotation speed of the drum from the second speed to a third speed at which an amount of the laundry tumbling increases, when an unbalance amount of the drum detected during the rotation of the drum at the second speed is a second specific value or less.

3. The method of claim 2, further comprising, when an unbalance amount of the drum detected during the deceleration of the drum from the second speed to the third speed is a third specific value or less, rotating the drum at a fourth speed so that all of the laundry adheres to the drum.

4. The washing machine of claim 1, wherein during the rotation of the drum at the first speed, the part of the laundry that tumbles is located closer to a center of the drum than the part of the laundry that adheres to the drum.

5. The washing machine of claim 4, wherein during the rotation of the drum at the first speed, a center of mass of each article of the laundry that tumbles is located closer to a center of the drum than a center of mass of each article of the laundry that adheres to the drum.

6. The washing machine of claim 1, wherein during the rotation of the drum at the first speed, a part of the laundry within the drum tumbles and another part of the laundry adheres to the drum at each rotational angle of the drum through a full revolution of the drum.

7. A method of controlling a washing machine that includes a drum, the method comprising:

rotating the drum at a first speed at which a part of the laundry within the drum tumbles and another part of the laundry adheres to the drum;

rotating the drum at a second speed lower than the first speed at which an amount of the laundry tumbling increases with respect to the first speed;

rotating the drum at a third speed lower than the second speed at which the amount of the laundry tumbling increases with respect to the second speed; and rotating the drum at a fourth speed calculated based on the first to third speeds so that the amount of the laundry tumbling increases with respect to the first speed.

8. The method of claim 7, further comprising, when an unbalance amount of the drum detected during the rotation of the drum at the fourth speed is a third specific value or less, rotating the drum at a fifth speed so that the laundry adheres to the drum.

9. The method of claim 7, further comprising rotating the drum at the fourth speed after stopping the rotation of the drum.

10. The washing machine of claim 7, wherein during the rotation of the drum at the first speed, the part of the laundry that tumbles is located closer to a center of the drum than the part of the laundry that adheres to the drum.

11. The washing machine of claim 10, wherein during the rotation of the drum at the first speed, a center of mass of each article of the laundry that tumbles is located closer to a center of the drum than a center of mass of each article of the laundry that adheres to the drum.

12. The washing machine of claim 7, wherein during the rotation of the drum at the first speed, a part of the laundry within the drum tumbles and another part of the laundry adheres to the drum at each rotational angle of the drum through a full revolution of the drum.

13. A washing machine, comprising:

a drum that rotates laundry; and a controller that:

controls the drum to be accelerated to a first speed at which a part of the laundry within the drum tumbles and another part of the laundry adheres to the drum;

controls the drum to rotate at the first speed; and controls the drum to be decelerated from the first speed to a second speed at which an amount of the laundry tumbling increases with respect to the first speed, when an unbalance amount of the drum detected during the rotation of the drum at the first speed is a first specific value or more.

14. The washing machine of claim 13, wherein the controller further controls the drum to be decelerated from the second speed to a third speed at which an amount of the laundry tumbling increases with respect to the second speed, when an unbalance amount of the drum detected during the rotation of the drum at the second speed is a second specific value or less.

15. The washing machine of claim 14, wherein, when an unbalance amount of the drum detected during the rotation of the drum at the first to third speeds is a third specific value or less, the controller further controls the drum to rotate at a fourth speed so that all of the laundry adheres to the drum.

16. A washing machine, comprising:

a drum that rotates laundry; and a controller that:

controls the drum to rotate at a first speed at which a part of the laundry within the drum tumbles and another part of the laundry adheres to the drum;

controls the drum to rotate at a second speed lower than the first speed so that an amount of the laundry tumbling increases with respect to the first speed;

controls the drum to rotate at a third speed lower than the second speed so that an amount of the laundry tumbling increases with respect to the second speed; and controls the drum to rotate at a fourth speed calculated based on the first to third speeds so that an amount of the laundry tumbling increases with respect to the first speed.

17. The washing machine of claim 16, wherein, when an unbalance amount of the drum detected during the rotation of the drum at the fourth speed is a first specific value or less, the controller further controls the drum to rotate at a fifth speed so that the laundry adheres to the drum.

18. The washing machine of claim 16, wherein the controller further controls the drum to rotate at the fourth speed after stopping the rotation of the drum.

* * * * *